United States Patent [19]

Vorzimmer et al.

[11] Patent Number: 4,797,657

[45] Date of Patent: Jan. 10, 1989

[54] PORTABLE SELF-CONTAINED INTRUSION DETECTOR FOR PASSENGER AIRCRAFT

[75] Inventors: Mark A. Vorzimmer, Houston; John Beardslee, The Woodlands, both of Tex.

[73] Assignee: Instant Security Systems, Inc., Houston, Tex.

[21] Appl. No.: 54,520

[22] Filed: May 27, 1987

[51] Int. Cl.[4] ..... G08B 13/18

[52] U.S. Cl. ..... 340/541; 340/63; 340/567; 340/691; 340/693; 340/945

[58] Field of Search ..... 340/693, 691, 945, 553, 340/554, 541, 567, 63; 367/93, 94

[56] References Cited

U.S. PATENT DOCUMENTS

| | | | |
|---|---|---|---|
| 3,205,482 | 9/1965 | Taylor, Jr. et al. | 340/693 |
| 3,430,219 | 2/1969 | Powers | 340/590 |
| 3,579,222 | 5/1971 | Freeman | 340/546 |
| 3,594,768 | 7/1971 | Harris et al. | 367/94 |
| 3,703,703 | 11/1972 | Payne | 340/691 |
| 3,710,371 | 1/1973 | Whalen et al. | 340/546 |
| 4,029,994 | 6/1977 | Iwans | 315/323 |
| 4,047,165 | 9/1977 | Andreassori et al. | 340/693 |
| 4,139,845 | 2/1979 | Washburn | 340/546 |
| 4,191,947 | 3/1980 | Bouchard et al. | 340/531 |
| 4,218,763 | 8/1980 | Kelley et al. | 340/539 |
| 4,222,043 | 9/1980 | Halavasi | 340/568 |
| 4,264,892 | 4/1981 | Zonn | 340/521 |
| 4,319,228 | 3/1982 | Daniels | 340/693 |
| 4,412,211 | 10/1983 | Lautzenheiser et al. | 340/514 |
| 4,438,428 | 3/1984 | Ober et al. | 340/521 |
| 4,446,454 | 5/1984 | Pyle | 340/538 |
| 4,532,507 | 7/1985 | Edson et al. | 340/541 |
| 4,638,294 | 1/1987 | Sakurai | 340/553 |

*Primary Examiner*—Glen R. Swann, III

*Attorney, Agent, or Firm*—Steele, Gould & Fried

[57] ABSTRACT

An intrusion detector for passenger aircraft has a portable housing including on board power means, at least one sensor operable to detect activity along a detection beam alignable to the aircraft and an indicator such as a strobe light providing a flashing-light alarm visible through the aircraft windows. The detector is self-sufficient, being carryable onto the aircraft by security personnel, and there activated without exposure to possible tampering. The sensor and/or indicator are armed after a delay allowing the security personnel to depart the detection zone, and activation of the indicator is delayed following detected activity, allowing security personnel to disarm the device by entry of a code, without indicating alarm conditions.

17 Claims, 2 Drawing Sheets

FIG. 1
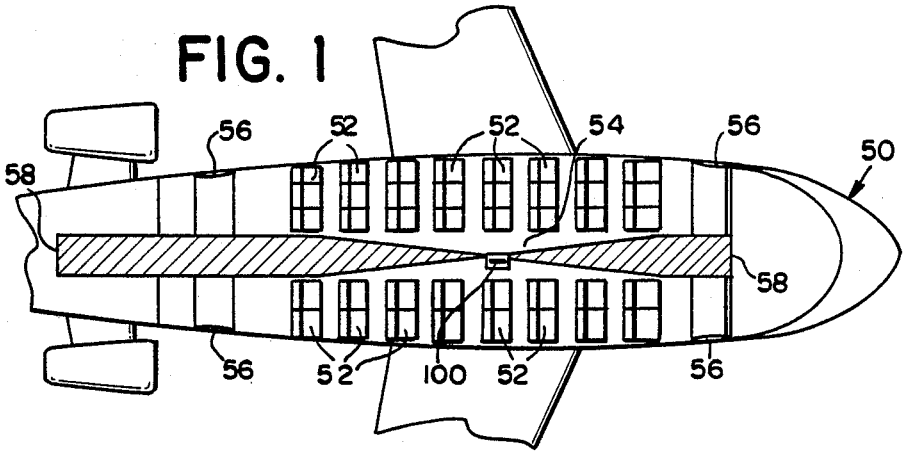
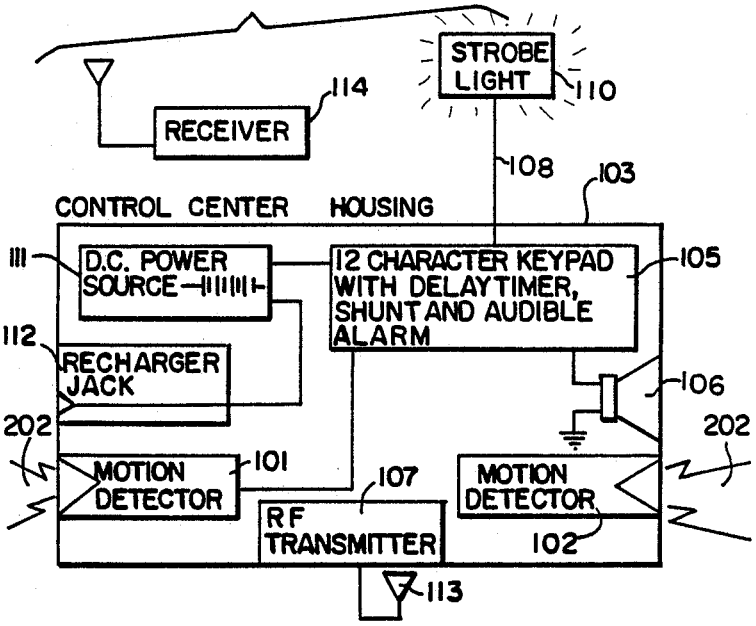
FIG. 2
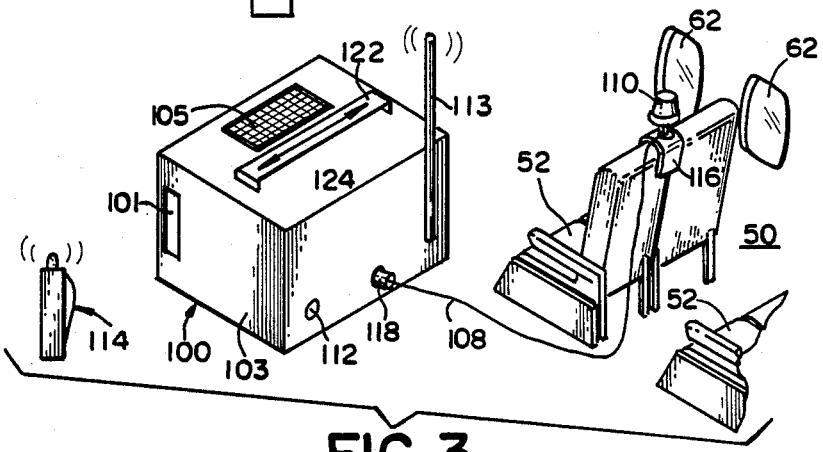
FIG. 3

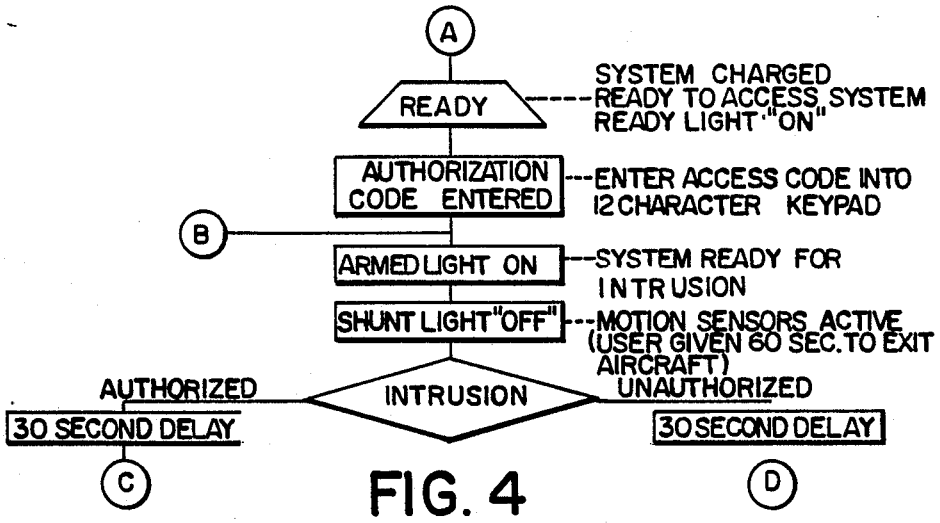
FIG. 4
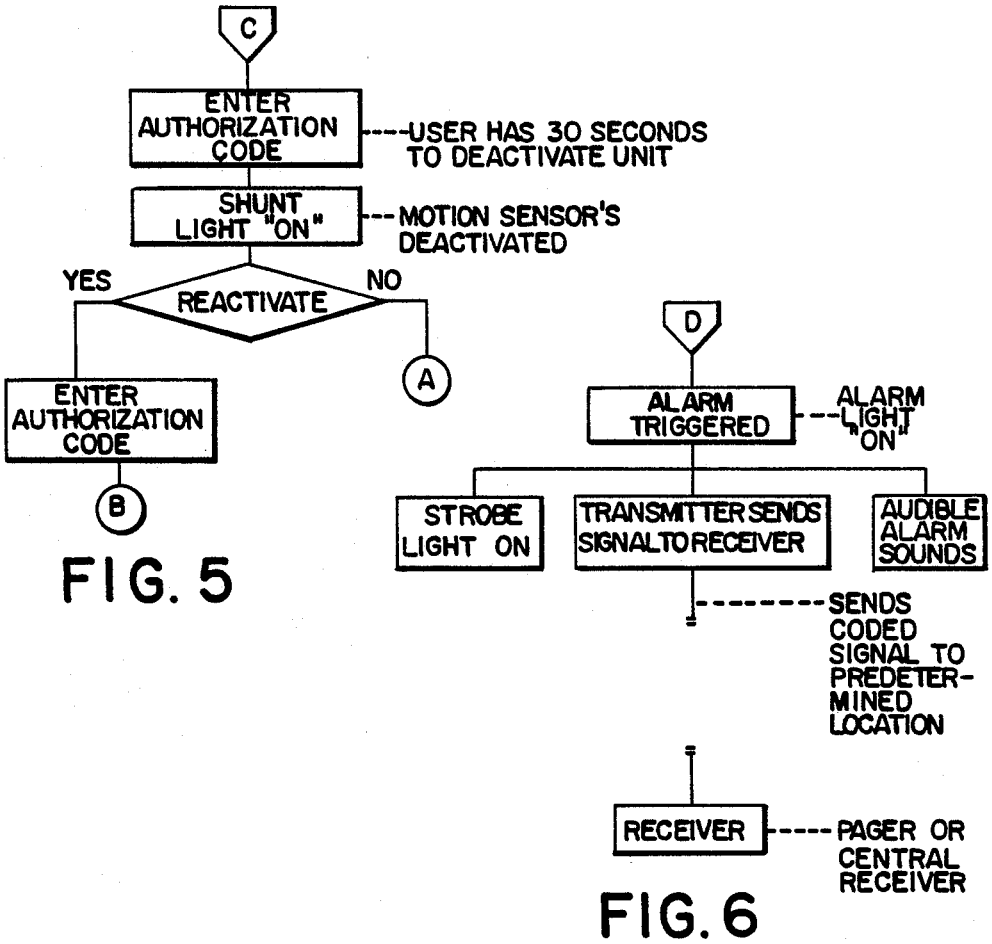
FIG. 5
FIG. 6

PORTABLE SELF-CONTAINED INTRUSION DETECTOR FOR PASSENGER AIRCRAFT

BACKGROUND OF THE INVENTION

1. Field of the Invention

This invention relates to the field of intrusion detectors, and more particularly to an intrusion detector specifically applicable for use in passenger aircraft, wherein the detector is self-contained and portable, can be located centrally in the aircrafts and detects activity along a beam alignable with the aisle of the aircraft, thereby protecting the aircraft whether the exterior doors are opened or closed.

2. Prior Art

Various forms of intrusion detectors are known for use in buildings, and intrusion detectors are also known for detecting attempts to gain access to closed and locked vehicles. Typically, intrusion detectors for vehicles are powered by the on board vehicle power supply (e.g. battery) or are mounted as securely and non-portably as can be arranged, whereby attempts to remove and disable the detector are impeded. Frequently, intrusion detectors or their alarm condition signalling means are concealed such that an intruder will not be aware that he has been detected. One would logically conclude that it is not advisable to provide a truly portable intrusion detector for a typical vehicle, because it would be relatively easy for an intruder to remove the entire portable detector from the vehicle, and to drive away before an appropriate security response on the part of the vehicle owner. Therefore, typical prior art intruder detectors for vehicles are rather permanently affixed to the vehicle and are not portable. A typical vehicle-type intrusion sensor is disclosed in U.S. Pat. No. 4,218,763-Kelley, et al.

A portable self-contained intruder detector described as useful for vehicles is disclosed in U.S. Pat. No. 4,222,043-Malavasi. The patent teaches a grounding-sensitive device for use on equipment including cars, aircraft and other equipment. When external connections to the intruder detector are broken, or when the ground connection of the vehicle is broken, for example when the vehicle is moved, an alarm circuit including silicon controlled rectifiers (SCRs) latches on and can only be reset using a switch. The device of this patent is useful for detecting when the vehicle is moved, but has no particular structure associated with the detector that is useful for preventing surreptitious access to aircraft, buses, trains, cars and the like, in which an intruder does not move the vehicle but visits it briefly, for example in order to install a bomb or to conceal contraband.

Air transportation systems have been especially susceptible to attacks by terrorists and criminals because aircraft in transit are especially vulnerable. Many lives have been lost. Heretofore, protection against acts of sabotage, vandalism and the like and efforts to thwart smugglers have been accomplished through airport perimeter security rather than vehicle internal security, and through the personal attention of security personnel.

An aircraft may be stationed at a passenger loading gate for long periods of time (for example all night), when access to the aircraft itself is not restricted directly but access to the general gate area is restricted by metal detectors and security cordons manned by security personnel. Of course, there is always a danger that airport staff or even security personnel may choose or be forced to collaborate with terrorists or criminals, allowing access to an aircraft on the ground. Nonmetallic or camouflaged explosive device and contraband can be passed through detection equipment. Even the most aggressive security procedures can be circumvented by the defection of one individual among many on the maintenance and security staff. An individual with free access to aircraft within the perimeter of a security system, presents a danger.

The present invention limits the access of even security personnel to aircraft within a secure perimeter. The intrusion detector of the invention is portable and self-contained and therefore is free of exposure to tampering during maintenance of the aircraft or other vehicle. Inasmuch as the detector is portable, only a very limited number of persons need have access and knowledge of installation and code procedures. The detector is hand-carried onto the aircraft and activated by the security person having custody, and is therefore safe from tampering. The housing of the detectoro is adapted to be aligned to the aisle between the aircraft seats, and preferably detects intrusion anywhere along aligned detection beams. Should even a security person gain access to the aircraft, the detector is activated. However, a time delay is preferably built in prior to activation of audible and visible alarm indicators, permitting security personnel to disable the device via a key or code entry. A key or switch pad-entered code is needed for programming as well as to disable the detector and a plurality of security levels can be defined, only the highest levels being able to accomplish critical changes such as password definition. Access to special codes and keys can be severely limited without undue inconvenience in day-to-day use.

Mounted detection and signalling devices having means to engage portions of buildings, rather than an aircraft, are known wherein the devices define detection beams. Reference can be made, for example, to U.S. Pats. Nos. 4,446,454-Pyle or 4,412,211-Lautzenheiser et al., each of which includes a sensor defining a detection means and a signalling device. These devices are useful, but apply to detection applications which are not as critical as aircraft. The typical building security system can be permanently installed without as great a danger of loss if intruders tamper with the system during maintenance on the premises.

Portable personal security devices are known in some variation. Typically, portable devices have an audible alarm and/or flashing light alarm that is activated whenever the portable alarm device is disturbed. The user places the portable device against a door or the like and the alarm is activated when the door is opened and the device disturbed. For example, a resiliently biased contact switch located on the bottom of the housing can be released and activated when the unit is knocked over (U.S. Pat. No. 3,579,222-Freeman). A window, door or similar means can produce a contact sensed disruption for operating a switch (U.S. Pat. Nos. 4,438,428-Ober et al.; 4,264,892-Zonn; 4,191,947-Bouchard et al.; 3,710,371-Whalen et al.; or 3,430,219-Powers).

The present invention is specifically adapted to severely limit access to passenger aircraft. One or more passive infrared sensing beams are preferably provided for motion detection the beams being alignable to the aisle, for example by engaging one of the passenger seats with the housing of the device. Vibration (e.g., sound) and electromagnetic (e.g. capacitance) sensors can be included. A radio-signalling means alerts a remote monitoring device, for example a portable beeper or central monitoring station, and this signal can be generated prior to or concurrently with any audible or visual alarm. To allow the location of the intrusion to be determined immediately amonng a plurality of aircraft or the like, facilitating apprehension the intruder, a strobe light is preferably arranged to flash within the aircraft cabin. This or other light emitting means can be spaced from the detector housing and connected by a flexible conductor to the housing, which is to be located remote from vehicle exits. The effect of the device is not only alert security personnel to the occurrence of an intrusion, but the particular aircraft subject to the alarm becomes a huge flashing indicator among other aircraft as all the passenger windows reveal the flashing strobe signal emitted therein.

Strobe lights have been used to illuminate exits for the safety of passengers, for example as shown in U.S. Pat. No. 4,029,994-Iwans. The invention on the other hand emits light outwardly, using the aircraft or other vehicle windows themselves as the light emitting portion. Preferably, audible, visible and signalling alarms are used in combination. Although these means are provided and are cooperative with structural features of the passenger vehicle, the alarm system itself is wholly portable and self-contained, requiring absolutely no operative connection to the passenger vehicle, being entirely self-sufficient, self-powered and therefore free of possible tampering.

SUMMARY OF THE INVENTION

It is an object of the invention to provide an intrusion detector specifically useful for passenger aircraft, and in which the detector is fully self-contained portable and subject to the exclusive custody of a limited number of authorized persons.

It is another object of the invention to provide an intrusion detector replacing on-board security systems and security systems intended for close monitoring by security personnel.

It is another object of the invention to avoid over reliance upon surveillance, employee security clearance and perimeter security controls at airports.

It is yet another object of the invention to minimize cost and maximize effectiveness of security apparatus for aircrafts.

These and other ojbects are accomplished by an intrusion detector for aircraft, with a portable housing including on-board power means, at least one sensor operable to detect activity along the aircraft aisle and an indicator such as a strobe light providing a flashing-light alarm visible through the aircraft windows. The detector is self-contained, and is programmable with security codes for disabling and enabling operation. A radio signal alerts remote stations to any unauthorized access to the aircraft.

BRIEF DESCRIPTION OF THE DRAWINGS

There is shown in the drawings the embodiments that are presently preferred. It should be understood that the invention is not limited to the precise arrangements and instrumentalities shown and is subject to embodiment in other combinations and groupings of elements within the scope of the invention as claimed.

FIG. 1 is a schematic section view of a passenger vehicle in which the invention is installed.

FIG. 2 is a schematic diagram showing elements of the invention.

FIG. 3 is a perspective view of the housing for the device, the attached strobe light being shown schematically as installed.

FIGS. 4–6 are schematic illustrations showing operation of the detector in its respective modes.

DETAILED DESCRIPTION OF THE PREFERRED EMBODIMENTS

The intrusion detector 100 according to the invention as shown in FIG. 1 is adapted to be positioned in a passenger aircraft 50, and to detect activity within sensor fields 202, for example passively detecting infrared variations along beams radiating in opposite directions from detector 100. Aircraft 50 may carry a large number of passenger seats 52, the seats defining at least one aisle 54. Detector 100 is arranged and aligned in aisle 54 such that sensor field 202 encompasses the areas of activity expected from persons entering aircraft 50, for example through side doors 56. Sensor fields 202 need not encompass all the available space within aircraft 50, but should at least cover areas immediately adjacent doors 56. Sensor fields 202 extend from detector 100 in straight lines, radiating away from detector 100 until a direct line-of-sight path from detector 100 terminates at cabin doors or bulkheads 58, placed fore and aft.

Aircraft 50 is to be protected from intrusion while standing idle and unoccupied. Aircraft commonly stand at passenger gates for long periods of time with entry ways 56 open. Some aircraft are more stable when supported in part by having entryway ramps extended to the ground. Typically it is the perimeter of the airport, and not the immediate area of aircraft 50, which is monitored by security personnel. According to the invention it is not necessary to entrust security personnel with the responsibility for monitoring the area in and around aircraft 50 to detect breaches of security. The invention concerns adapting intrusion detector 100 such that only a very-limited number of authorized security personnel can arm or disarm intrusion detector 100, or approach detector 100 without setting off an appropriate intruder-detected alarm. This is accomplished by means of a security keying means, for example a key pad into which any person approaching the detector (being thereby sensed as a possible intruder) must enter a code, in order to prevent actuation of detector 100.

The respective elements of detector 100 are shown in FIG. 2. Within a housing 103 of detector 100, a pair of sensors 101,102, namely, passive infrared detectors, are mounted such that detection beams, 202 radiate in the required directions, the beams being aligned to the same direction as the alignment arrow on the handle 124. It is possible to orient the beams perpendicularly, for example to detect movement on an enclosed ramp leading to the aircraft and along the aisle, respectively. Preferably, detection beams, 202 are oriented in a straight line along an axis of aircraft 50, for example along at least one aisle between the seats as shown in FIG. 1. Accordingly, activity anywhere along the aisle will be detected by detector 100, and an alarm will be issued provided one of the limited number of security personnel knowledgeable about the detector's security code does not first disable the alarm by entry of the required code.

Detector 100 is entirely self-sufficient, having an internal DC power source 111, rechargeable via an externally-accessible recharger jack 112 and all necessary apparatus carried in and on the housing and its attachments. Recharger jack 112 may be powered with alternating current and connected through a rectifier and current-limiting means (not shown) to DC power source 111, for example a rechargeable battery. The respective elements of the device, including the control and keying means 105, audible alarm means 106, activity detectors 101,102, RF transmitter 107 and visible indicator 110 are all powered from DC power source 111. Remote receiver 114 is responsive to a signal broadcast from RF transmitter 107 through antenna 113, which signal is transmitted when intrusion is detected.

A physical embodiment of the invention is shown in FIG. 3. Detector 100 in housing 103 is embodied as a simple portable box with sensor 101 directed along a line substantially parallel to a surface upon which housing 103 is placed. RF antenna 113 protrudes upwardly from the box and can be arranged as a telescopically extendible antenna if desired. A carrying means such as handle 122 is disposed on top of the housing 103. A key switch pad 105, accessible for example on top of housing 103, allows the user to arm, disarm and otherwise program intrusion detector 100, for example by enabling detector functions. Key pad 105 is used, for example, to enter security codes for arming and disarming the device, and can also be used to program internal operations such as particular delay times between detection of activity within the field and activation of alarm indicators including, for example, audible source 106, strobe light 110 and the like. In this way the detector delay can be set to depend on the distance to the nearest entry, etc. It is also possible to have some functions (e.g., enable and disable) controlled by lower-security codes and more critical functions (e.g., changing the enable and disable codes) controlled using codes to which access is even more limited. Strobe light 110 is preferably connected to the detector 100 by means of a flexible connector 108, terminating in a plug to be fit in jack 118 in housing 103. Accordingly, detector 100 can be used if desired without strobe 110. Preferably, strobe 110 is used whenever the device is employed in an aircraft, in order to thereby indicate by light shining through windows 62 of the aircraft 50 that alarm-conditions exist. Strobe 110 can be mounted directly on seat 52 of aircraft 50 by means of a harness 116 that fits over the seat and positions strobe 110 at an appropriate location adjacent the windows or at least at window level.

A remote detector 114, shown in FIG. 3 and shown schematically in FIG. 2, can take the form of a beeper-type portable unit with an audible and/or visible alarm means. Security personnel generally can be equipped with such a beeper device. Preferably, beeper device 114 is not adapted to determine which of a plurality of individual intrusion detectors 100 at an airport including a number of aircraft 50, has actually initiated an alarm condition. The security personnel having noticed activation of remote beeper 114, need only look into the aircraft area to determine which of the aircraft is showing an alarm condition by virtue of strobe light 110, flashing visibly through the window 62 along the fuselage. Preferably an audible alarm is also activated, being housed in the detector housing. The audible alarm and the strobe form of visible alarm make the location of the alarm quite readily apparent, the entire aircraft functioning as a visible warning element when light is emitted through the row of windows 62 normally appearing along the fuselage and the audible alarm sounding continuously or intermittently.

Detector 100 is preferably arranged to align itself to the aisle 54 of aircraft 50, by virtue of housing features and/or aiming devices. As shown in FIG. 3, an indication such as alignment arrow 124 can be provided, for example on handle 122 of housing 103. It is also possible to arrange other alignment means, for example, a switch activated flash light beam aiming device (not shown) can be incorporated in housing 103. Upon installation of detector 100, the user simply aligns indicator 124 to the aisle, or activates the flashlight beam means until the beam, which is aligned to the invisible detection beam, is roughly centered on one (or both) of opposite bulk heads 58. The opposite detection beams 202 radiating from detector 100 are then properly aligned to aisle 54 of aircraft 50.

In addition to alignment by indicator 124 and/or by other alignment means (e.g., an aiming beam source) provided in housing 103, the intrusion detector according to the invention engages directly on seat 52 by means of harness 116 carrying strobe light 110. It is also possible to arrange a physical engagement means on housing 103 to attach to a predetermined portion of aircraft 50 to thereby align the detection beam(s) to the aircraft aisles or other desired detection zones. In another preferred embodiment (not shown), housing 103 of detector 150 has a clasp means arranged to connect directly on seat 52, for example by shaping handle 124 with a flange or hook to extend over the arm rest of seat 52, adjacent the central aisle area of the aircraft. Seat 52 being already aligned to the longitudinal axis of aircraft 50, detection beams 202 thereby become aligned to the aisle. Accordingly, detector elements 101 preferably are mounted on an extreme edge of housing 103, to position the beams 202 more nearly in the center of aisle 54.

The sensor elements of the detector can be supplemented by other sensor elements, for example sensors on board the aircraft such as door-closing sensors, etc. It is also possible to wire remote sensors such as pressure sensitive floor pad switches, back to the housing. The device, in any event, is a self sufficient, carry-on alarm.

Operative modes of the invention are illustrated in flow chart form in FIGS. 4–6. Referring to FIG. 4, prior to actuation the device remains in a "ready" mode. Preferably, a visual indication (i.e., a "ready" light) is provided to indicate the standby or ready-to-access mode. This indicator light can be arranged, for example, as an LED mounted in the area of key pad 105. In order to activate the intrusion detection system, an authorized person such as one of a very limited number of security personnel who are knowledgeable about appropriate authorization codes which the detection device is programmed to accept, enters a code into key pad 105. Key pad 105 can be, for example, a typical code-operated digital lock, programmed to provide certain output signals upon entry of at least one correct authorization code. When the authorization code is entered, and preferably after a short delay allowing the security personnel to depart the detection zone the intrusion detector goes into the "armed" mode. An additional LED or other appropriate light can be activated to distinguish between the armed and standby modes.

Prior to full activation in the armed mode, the short delay or "shunt" mode exists for a time period that can also be made programmable. Although activated, during the initiation or detection delay authorized persons have an opportunity to either exit the aircraft (upon initial arming) or to deactivate the sensor (upon returning to remove the intrusion detector).

The particular procedures initiated upon detecting intrusion can be according to various schemes used individually or in combination. Preferably, the intrusion detector includes at least one means for detecting activity along one or two opposed beams 202 of sufficient range to allow detection in a zone substantially closing off access to the interior of the aircraft, e.g., from front bulkhead 58 to rear bulkhead 58, i.e. along the entire aisle 54 of aircraft 50. An appropriate sensor element is a passive infrared detector ("PIR"), of the type known in the art in connection with installed intrusion detection apparatus. Such detectors are responsive to momentary changes in heat patterns, detected optically, for example as occurs when a person crosses the path in front of a background such as bulkhead 58. Such a detector can be used in conjunction with other detectors such as detectors responsive to variations in local capacitance, acoustic signal detectors or means for detecting a variation in overall capacitance of conductive portions of the aircraft, for example when a user standing outside the aircraft on the ground touches a metal part of the fuselage or other equipment. This latter form of detector may not be possible where the fuselage is grounded to preclude static buildup.

The specific means by which the intrusion detector 100 responds to the presence of an intruder can be controlled by switches. For example, it may be appropriate in the case of aircraft parked immediately adjacent active runways, to avoid the use of acoustic detectors that could be erroneously operated by engine noise from passing aircraft. Similarly, should detection be desired only within the aircraft, leaving free access to external portions of the aircraft for example for refueling, then the capacitive detectors can be disabled temporarily. The responses programmed upon detection of various conditions can be made re-programmable. As another alternative, the detection of activity of various types can be arranged to cause different detector responses. For example, PIR sensor detected activity can set off the full alarm indicating set of lights, bells and radio signals, while detection of capacitive variation without accompanying PIR sensor or acoustic activity can be arranged to produce only a signal. If the cause is refueling in progress, security personnel can visually confirm such status, or if not confirmed visually, would suspect surreptitious activity. Any change in these responses affects security status and must be accompanied by entry of an authorization code on key pad 105. Access to reprogramming codes can be even more restricted than access to enable/disable codes.

The particular length of time delay between initial entry of an authorization code and active detection of alarm conditions, for example a thirty second delay, can also be made programmably variable by means of switch pad 105. The object of the delay is to allow an authorized person arming the device time to exit the aircraft prior to initiation of alarm conditions, or upon re-entry into the aircraft time to deactivate the intrusion detector in order to avoid spurious indication of alarm conditions. This short delay, e.g., thirty seconds should be sufficient to allow the security person to briskly move between the exit and intrusion detector 100 and to enter the code. Unnecessary additional delay could give an unauthorized person an opportunity to attempt to damage or disable the intrusion detector, for example by covering stroke 110 with opaque material, grounding antenna 113 and/or muffling acoustic alarm 106. Should the delay be set close to the time required to reach the detector 100 from the exit, which time period can be programmably variable from aircraft to aircraft, the unauthorized intruder will be given insufficient time to substantially affect operation.

In another preferred embodiment, the transmission of an "intrusion-detected" radio signal can be made immediately upon detection of activity by one or more of the sensors, and not after a delay as required prior to actuation of the visible and audible alarms. This signal can be followed by a second coded signal indicating "all is well", provided the system is deactivated within the delay period. Similarly, upon initial arming, the device can signal "all is well", which then is interpreted as an indication that security precautions are in force on that aircraft.

FIG. 5 illustrates a preferred sequence of modes provided the user enters an authorization code, and deactivates the system within the delay period. In this case, a shunt status light changes state, and depending upon whether or not the system is reactivated, detector 100 moves into the standby mode or the armed mode.

Should a detected intruder not enter an appropriate authorization code within the prescribed delay or shunt term, alarm status is triggered. The system goes into the full alarm indicating and signalling condition, including activation of indicator lights including strobe 110, and emission of audible alarm via audible alarm means 106. Similarly, the radio transmitter 107 broadcasts a signal alarm 113, which is received at remote units 114 and interpreted to indicate alarm conditions. This signal can be coded to prevent jamming by intruders broadcasting a plurality of spurious alarms, and can include specific code characters representing the identity or location of the aircraft, or at least the particular intrusion detector 100 emitting the alarm. This allows the radio signal as well as the strobe light to indicate which of the aircraft 50 has been compromised. A central receiver (not shown) can also be provided, programmed responsive to the codes of all detectors in use at a facility, to allow security personnel to trace the origin of an alarm. The individual remotes, such as paging beeper units 114, need not be provided with such code means in that case, being simply operable to indicate that an intrusion detector has been triggered somewhere within the range of the RF link.

The particular character of the RF link can be subject to some variation. A tone can be broadcast at a frequency but including walkie-talkie transmissions, i.e. upon public frequencies but including coded signals. In order to prevent monitoring and/or jamming by unauthorized personnel, it is also possible to employ separate frequency channels for each of the transmitters and to use the cessation of a tone signal for a predetermined interval, rather than presence of the tone, as the "alarm-actuated" condition indicator. The transmission can be a coded digital signal, programmed on key pad 105 after entry of an appropriate security acess code, whereby the codes can be changed frequently and/or unpredictably. Should security personnel detect any activity whatsoever in code-transmission channels, unauthorized activity can, of course, be suspected.

The portable nature of the invention makes it impossible to tamper with the security system during normal maintenance procedures on aircraft 50. The detector 100 is simply not arranged to include or depend upon any part of the aircraft 50. The detector is neither powered by means common to aircraft 50, nor embodied to be responsive to any movable aircraft part, connector electrical device or the like. The integrity of the security system therefore remains entirely within the control of the limited number of security personnel who are advised of the appropriate authorization codes, codes for enable/disable and possibly programming. Aircraft 50 is therefore made safe from unauthorized intrusion even if such intrusion is caused or condoned by regular airport personnel collaborating with others.

The detection device of the invention is a self-sufficient detector and indicator that is in part effective due to its lack of any need to rely on aircraft movable parts, electrical power supplies and the like. The detection device is thereby removable when notactivated and is protected from tampering. The device can be supplemented by aircraft borne sensors, detectors and/or power, but does not relay on them.

The invention having been disclosed, a number of additional embodiments will now occur to persons skilled in the art. Reference should be made to the appended claims rather than the foregoing specification as indicating the true scope of the invention.

What is claimed is:

1. An intrusion detector for passenger aircraft, comprising:

a portable housing adapted to be hand carried into a detection zone within the aircraft;

a battery disposed in the housing, the battery being connected to power the detector apart from connection to a power source in the aircraft;

at least one detection device including an infrared motion sensor, disposed within the housing and operative to detect activity in the detection zone; and a control means connected to the at least one detection device, the control means also being connected to activate at least one of an indicator and a signaling means when said activity is detected, the control having a delay feature operable for at least temporarily disabling the intrusion detector such that an authorized individual can temporarily occupy the detection zone without triggering the control means.

2. The detector of claim 1, wherein the control means includes a means for entering a code and for comparing the code to at least one authorized code sequence stored in the control means.

3. The intrusion detector of claim 1, wherein the detection device is at least responsive to motion in the detection zone along at least one detection beam extending along a predetermined line from the housing, the beam being alignable to the aisle of the aircraft by aligning the housing relative to the aisle.

4. The intrusion detector of claim 3, further comprising means on the housing operable to align the housing and the beam relative to the aisle, said means on the housing being adapted to cooperate with a predetermined section of the aircraft whent he housing and the beam are aligned to the aisle.

5. The intrusion detector of claim 4, wherein the housing is provided with aligning arrows showing the direction of the detection beam.

6. The intrusion detector of claim 3, wherein the detection device is responsive to motion along at least two oppositely-directed passive infrared detection beams radiating from the detector, whereby the detector sensed approaching activity from either direction when placed in the aisle and aligned to the aisle.

7. The intrusion detector of claim 1, wherein the control means operates an indicator, the indicator including at least one of a light, an audible alarm and a radio-signaling means.

8. The intrusion detector of claim 7, wherein the light is a stobe light operable to emit light throughout a cabin of the aircraft, and further comprising means for mounting the strobe light at a space from the casing, whereby an interior of the aircraft is substantially illuminated upon activation of the strobe light, as viewed through a plurality of windows of the aircraft.

9. The intrusion detector of claim 8, further comprising a seat-engaging bracket for mounting the strobe light to a seat back, whereby light from the strobe light is visible at a level of a window of the aircraft.

10. The intrusion detector of claim 1, wherein the control includes a timer operable to definen a predetermined delay interval between detection of activity in said detection zone and activation of the indicator, whereby an arriving authorized individual can disable the intrusion detector during said delay interval.

11. An intrusion detector for a passenger aircraft, comprising:

a portable housing including an internal power supply sufficient to operate the intrusion detector for a predetermined time, the housing being adapted to be hand carried onto the aircraft, the intrusion detector being self-contained and operable free of connections to the aircraft;

at least one detection device including a passive infrared sensor disposed in the housing and operative to detect activity in a detection zone;

an indicator operative to change state for indicating activity in the zone; and, a control means connected to the detection device and indicator, including means operable to disable the intrusion detector for at least one of an initial delay and an activation delay, the initial delay allowing an authorized individual installing the intrusion detector to depart prior to activation thereof, the activation delay allowing an authorized individual to arrive and disable the intrusion detector, also without activating the indicator.

12. The intrusion of claim 11, wherein the detection device is operable to detect activity within a zone defined by an aisle of a passenger cabin of said aircraft, the detector being at least responsive to motion along predetermined detection beams oriented away from the housing and in opposite directions along the aisle.

13. The intrusion detector of claim 12, wherein the detection device is operable to detect activity along detection beam radiating substantially symmetrically from the housing along a longitudinal axis, and further comprising means on the housing for indicating the longitudinal axis, whereby the casing can be aligned to the aisle of the aircraft.

14. The intrusion detector of claim 12, wherein the indicator includes at least one of a light, an audible alarm and a radio-signaling means, the light being operable to emit light generally within a cabin of the aircraft, whereby the light shines through a plurality of windows of the aircraft.

15. The intrusion detector of claim 14, wherein the light is a strobe light, and further comprising means for positioning the strobe light on a seat back adjacent a window of the aircraft.

16. The intrusion detector of claim 14, further comprising at least one portable radio receiver responsive to said radio signalling means.

17. The intrusion detector of claim 11, wherein the detection device includes at least one of an optical sensor, acoustic sensor and capacitive sensor.

* * * * *